United States Patent [19]

Anderson

[11] Patent Number: 4,986,576

[45] Date of Patent: Jan. 22, 1991

[54] LOCKING DOOR LATCH

[75] Inventor: John P. Anderson, Norco, Calif.

[73] Assignee: The Hartwell Corporation, Placentia, Calif.

[21] Appl. No.: 509,201

[22] Filed: Apr. 16, 1990

Related U.S. Application Data

[63] Continuation of Ser. No. 291,279, Dec. 27, 1988, abandoned.

[51] Int. Cl.[5] ..... E05C 1/16

[52] U.S. Cl. ..... 292/40; 292/DIG. 31; 292/DIG. 41; 292/DIG. 55; 70/107

[58] Field of Search ..... 70/208, 107; 292/DIG. 31, 37, 143, 169.13, DIG. 41, 40, 302, 169 R, DIG. 55, DIG. 39

[56] References Cited

U.S. PATENT DOCUMENTS

| | | | |
|---|---|---|---|
| 302,657 | 7/1884 | Heizmann et al. | 292/245 |
| 1,102,855 | 7/1914 | Becker | 292/DIG. 39 X |
| 1,579,619 | 4/1926 | Kerby | 292/DIG. 55 X |
| 2,198,079 | 4/1940 | Ferris et al. | 292/143 |
| 2,900,204 | 8/1959 | Pelcin | 292/173 |
| 3,209,563 | 10/1965 | Pelcin | 70/146 |
| 3,495,862 | 2/1970 | McClintock | 292/173 |
| 3,698,215 | 10/1972 | Truhon | 70/152 |
| 3,719,380 | 3/1973 | Watermann | 292/216 |
| 3,745,796 | 7/1973 | Fleming | 70/208 X |
| 3,831,988 | 8/1974 | Stelma | 292/DIG. 41 X |
| 3,858,919 | 1/1975 | Kleefeld et al. | 292/216 |
| 3,876,238 | 4/1975 | Waterman | 292/216 |
| 3,881,331 | 5/1975 | Tranberg et al. | 70/107 |
| 3,917,329 | 11/1975 | Fujiki et al. | 292/169.13 X |
| 3,934,435 | 1/1976 | Gresham | 292/DIG. 31 X |
| 4,165,112 | 9/1979 | Kleefeldt | 292/216 |
| 4,312,527 | 1/1982 | Tannery | 292/49 |
| 4,335,595 | 6/1982 | Swan et al. | 70/149 |
| 4,357,039 | 11/1982 | Tolle | 292/341.12 |
| 4,386,798 | 6/1983 | Menard | 292/336.3 |
| 4,412,695 | 11/1983 | Arlauskas | 292/173 |
| 4,428,606 | 1/1984 | Proffer | 292/181 |
| 4,457,146 | 7/1984 | Weinerman | 70/100 |
| 4,478,441 | 10/1984 | Fiordellisi et al. | 292/216 |
| 4,489,576 | 12/1984 | Mullich et al. | 292/143 X |
| 4,492,395 | 1/1985 | Yamada | 292/216 |
| 4,569,544 | 2/1986 | Excaravage | 292/216 |
| 4,586,737 | 5/1986 | Arlauskas | 292/216 |
| 4,641,865 | 2/1987 | Pastva | 292/5 |
| 4,679,834 | 7/1987 | Gotanda | 292/169.13 |
| 4,679,836 | 7/1987 | Pupillo et al. | 292/216 |

*Primary Examiner*—Richard E. Moore

*Attorney, Agent, or Firm*—Harris, Kern, Wallen & Tinsley

[57] ABSTRACT

A locking entry door latch equipped with a positive locking dead bolt and a latch bolt. The latch includes a housing, a sliding latch bolt mechanism, a sliding dead bolt mechanism, a center bolt to resist longitudinal loading, a strike assembly with a precatch that holds the door latched when it is not completely closed and a final catch for the latch bolt and dead bolt, a locking mechanism and inside and outside operating handles. Both the locking mechanism and the operating handles are independently operable from inside or outside the vehicle.

19 Claims, 5 Drawing Sheets

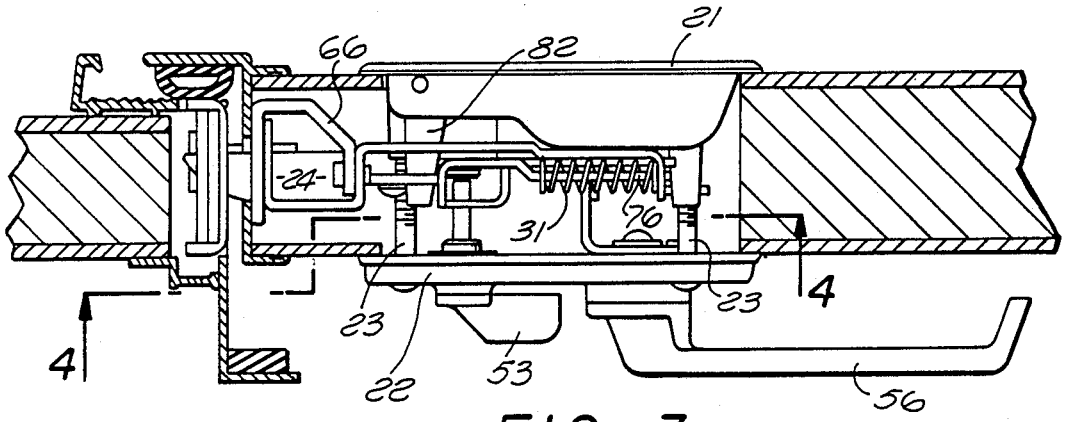
FIG. 3
FIG. 4
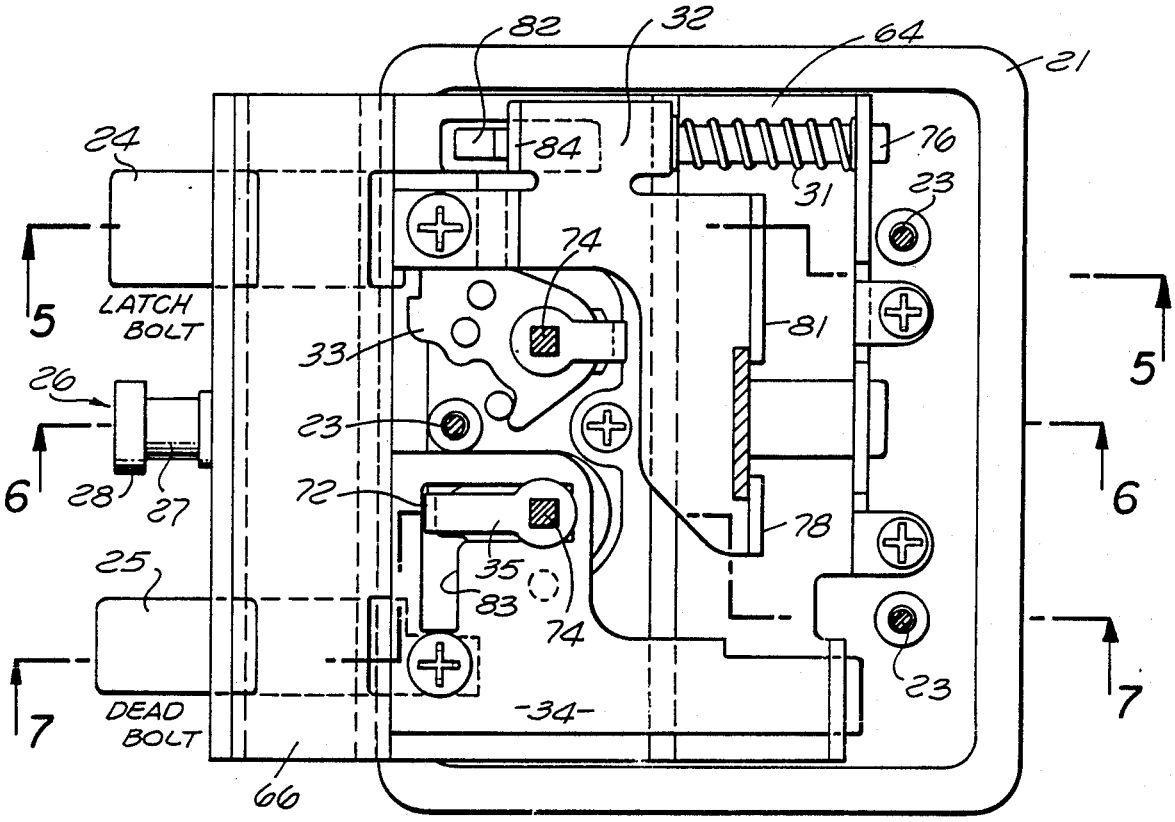

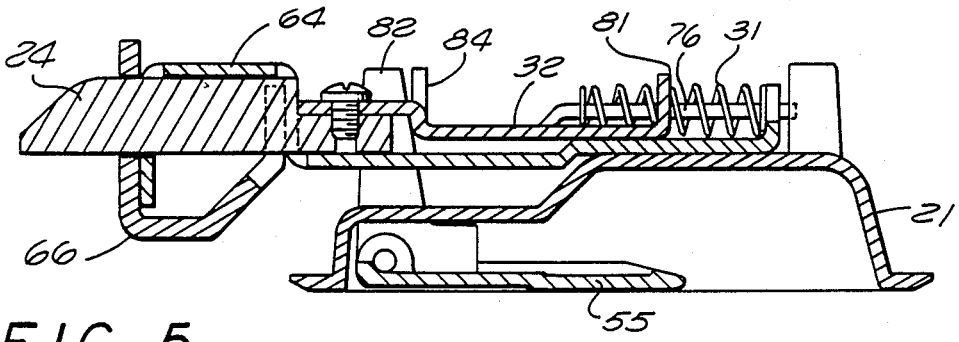
FIG. 5
LATCH BOLT
FIG. 6
CENTER BOLT
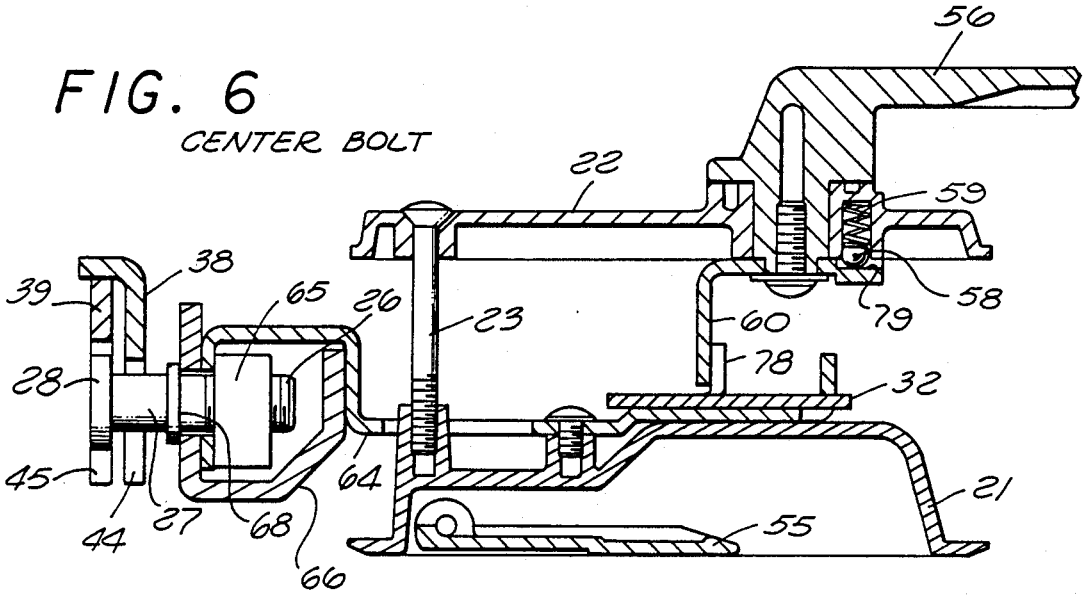
FIG. 7
DEAD BOLT
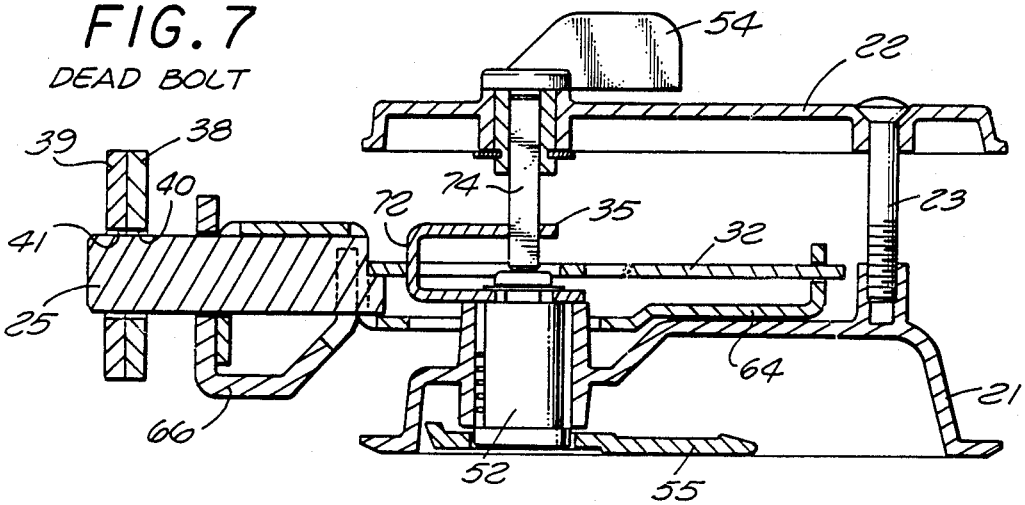

LOCKING DOOR LATCH

This is a continuation of application Ser. No. 07/291,279, filed Dec. 27, 1988, now abandoned.

BACKGROUND OF THE INVENTION

Typically on motor homes and travel trailers the main entrance door leading into the living quarters and other restricted areas is secured with a latch equipped with a locking mechanism that can be operated from inside or outside the vehicle.

It is common practice to have large numbers of these locks all keyed alike. The reason for this is to reduce the number of different keys the manufacturer and dealer have to contend with while the vehicle is in their possession. It is more convenient for a dealer to unlock a number of vehicles with one master key when showing to customers than to locate and carry around a separate set of keys for each vehicle on the lot.

Unfortunately this practice offers very little security against unauthorized entrance into the motor home, so in addition to the locking door latch a separate dead bolt is installed in each door. The dead bolt is designed to be keyed to a higher number of key configurations, to reduce the chance of a key from one motor home being able to unlock the dead bolt of the door of another.

The dead bolt can be kept unlocked while on the dealers lot so he can enter any vehicle with a master key, yet the additional security is available for the final owner when required.

This arrangement of a latch bolt lock and a separate dead bolt lock appears to offer the easy access needed by the dealer and the security and peace of mind required by the final owner of the vehicle, but creates other problems in the way of added costs for the additional security.

Having to install two separate units in each door means higher costs, due to the additional labor and materials required for the additional inventory, door preparation and installation, all of which is paid for by the customer in the way of higher product cost.

SUMMARY OF THE INVENTION

It is an object of the present invention to provide a door latch with improved security features, thus eliminating the need for additional locking devices beyond the primary latch assembly.

Another object of the invention is to provide a latch of the above stated character that is strong enought to meet the requirements of automotive, architectural and industrial applications, yet is compact enough to offer styling and functional advantages over the latches in use today.

A particular object is to provide an entrance door latch with no need for a separate dead bolt assembly to be installed in the door, rather incorporating a positive locking, sliding dead bolt arrangement as an integral part of the latch assembly.

The latch of the invention not only fulfills the easy access and additional security requirements in one small package, but offers the motor home industry needed functional and styling features.

The low profile compact design of the outside housing and handle of the latch of the invention offers very little interruption to the smooth styling lines of today's modern motor home and industrial architecture, with the low profile design of the outside housing and handle resulting in a flush mounting latch. A dished outside housing incorporates a flat paddle handle for operation of the latch from the outside of the vehicle.

The latch is primarily intended for an industry such as motor homes and trailers and other vehicles that are required to meet the Motor Vehicle Safety Standard No. 206, but it's use is not restricted to these vehicles alone, as there is a general need for this type of latch on other vehicles and for numerous stationary applications as well, and it is also an object of the invention to provide such a latch which has general application to all types of closures.

BRIEF DESCRIPTION OF THE DRAWINGS

FIG. 3 is a sectional view taken along the line 3—3 of FIG. 2;

FIG. 4 is a sectional view taken along the lines 4—4 of FIG 3;

FIGS. 5, 6 and 7 are sectional views taken along the lines 5—5, 6—6, and 7—7, respectively, of FIG. 4;

DESCRIPTION OF THE PREFERRED EMBODIMENT

Figure 1:
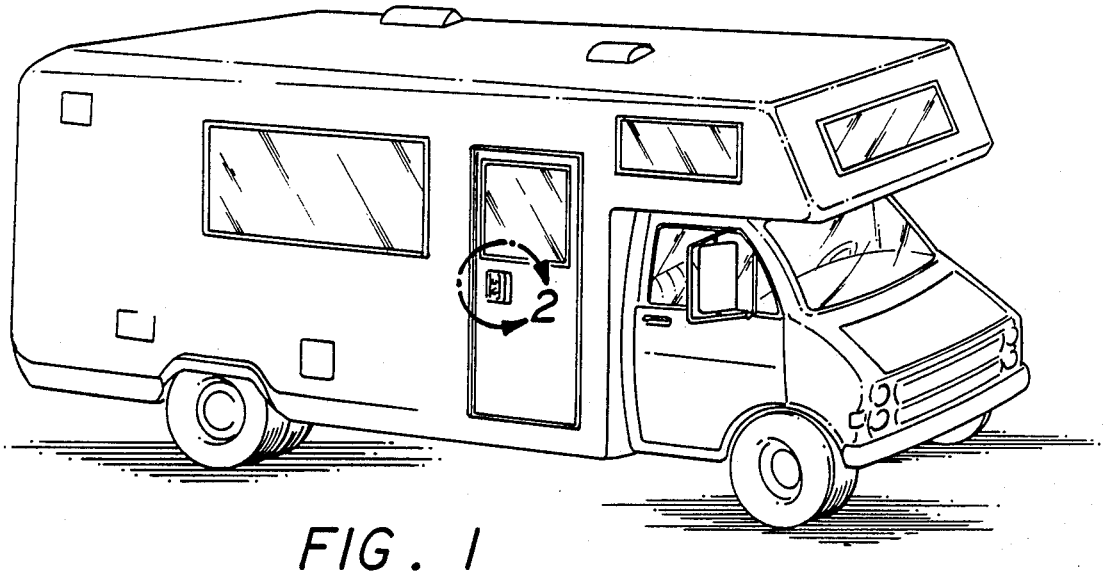
FIG. 1 is a perspective view of a motor home with the presently preferred embodiment of the invention installed therein.

The latch includes a housing with an outer cover 21 and an inner cover 22 joined by screws 23. A latch bolt 24, a dead bolt 25 and a center bolt 26 are carried in the housing. The center bolt has a center section 27 of lesser diameter than an end section 28. The latch bolt and dead bolt may each be a unitary piece or may be a two piece construction with a hardened rod or bar carried in the body and extending outward for engaging the strike.

Control means are provided for the latch bolt and include a spring 31, a latch cam plate 32 and a stop 33. Control means are provided for the dead bolt and include a dead bolt cam plate 34 and a dead bolt cam 35.

A strike or keeper has an inner plate 38 and an outer plate 39, with openings 40, 41, 42 and 43, and slots 44, 45.

The latch bolt is moved between locked and unlocked conditions by a latch key lock 51 and the dead bolt is moved between locked and unlocked positions by a dead bolt key lock 52. The latch bolt and the dead bolt are locked in place by locking handles 53, 54, respectively, and the latch bolt is moved to the unlocked position by an outside handle 55 and an inside handle 56. The inside handle is centered by detent means including a ball 58, spring 59, and notched detent cam 60.

The two key actuated lock cylinders 51, 52 are accessed through openings in the outside handle 55 for operation of the dead bolt 25 and the latch bolt 24.

Two small locking handles 53, 54 are rotatably attached to the inner cover for operation of the latch bolt and the dead bolt, respectively, from inside the vehicle.

A turn handle 56 is also rotably attached to the inner cover of the housing, and can be rotated in either direction to operate the latch. This symmetrical handle operation means the latch can be mounted in either left or right hand doors without any sacrifice in convenience of operation.

The inner and outer strike plates or strikes 38, 39 are mounted in the door frame and have rectangular openings positioned to receive the latch bolt and the dead bolt when the door is closed.

Figure 2:
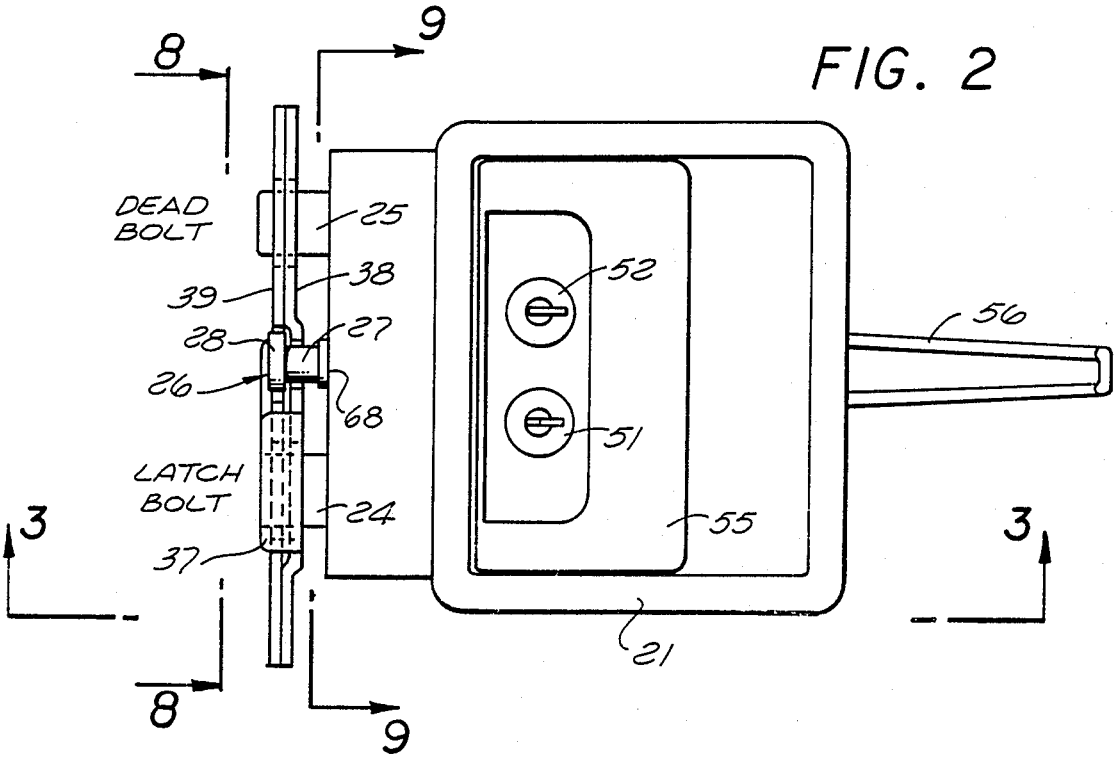
FIG. 2 is an enlarged side view of the latch of FIG. 1 taken from the exterior.
Figure 8:
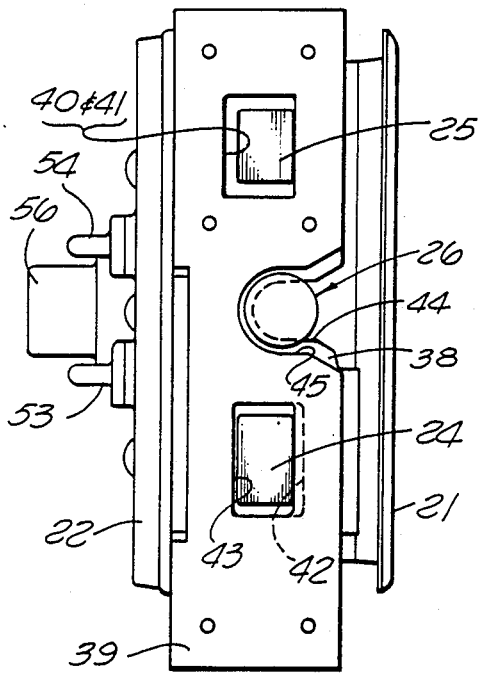
FIGS. 8 and 9 are sectional views taken along the lines 8—8 and 9—9, respectively, of FIG. 2.
Figure 9:
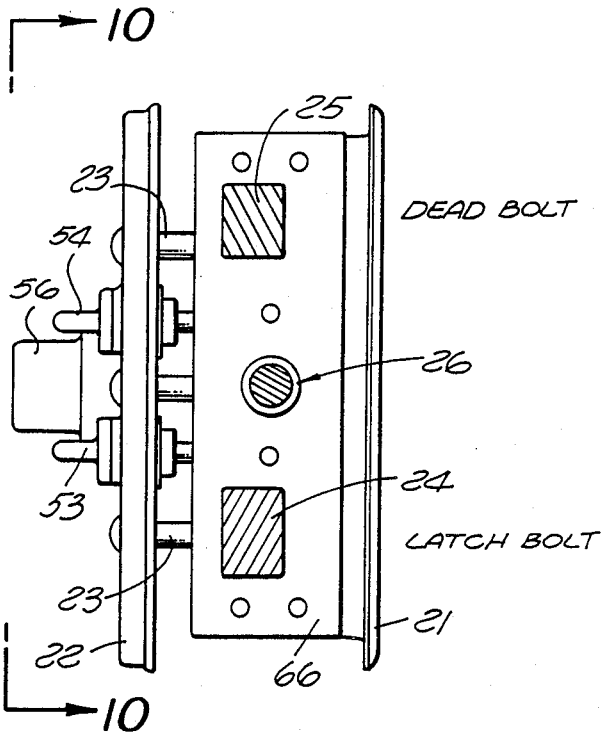
Figure 10:
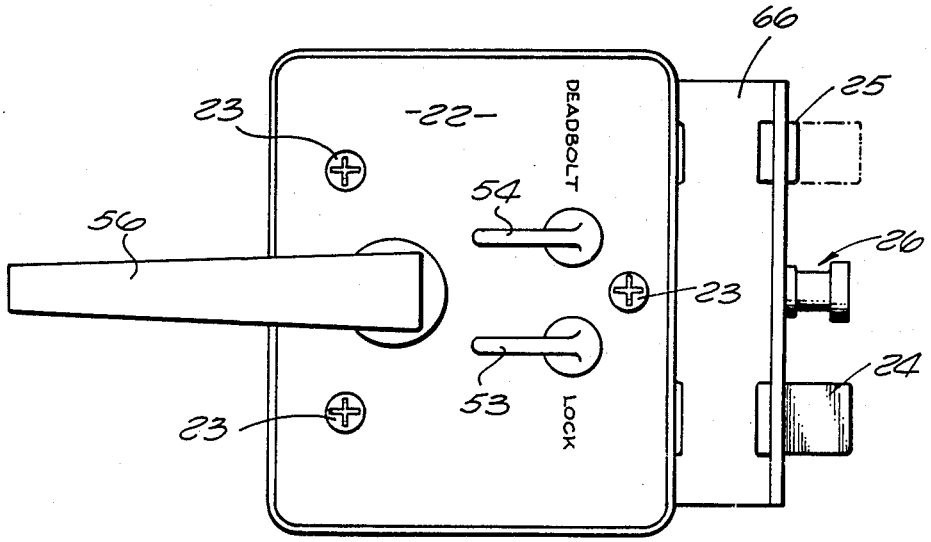
FIG. 10 is a view similar to that of FIG. 2 taken from the opposite or interior.
Figure 11:
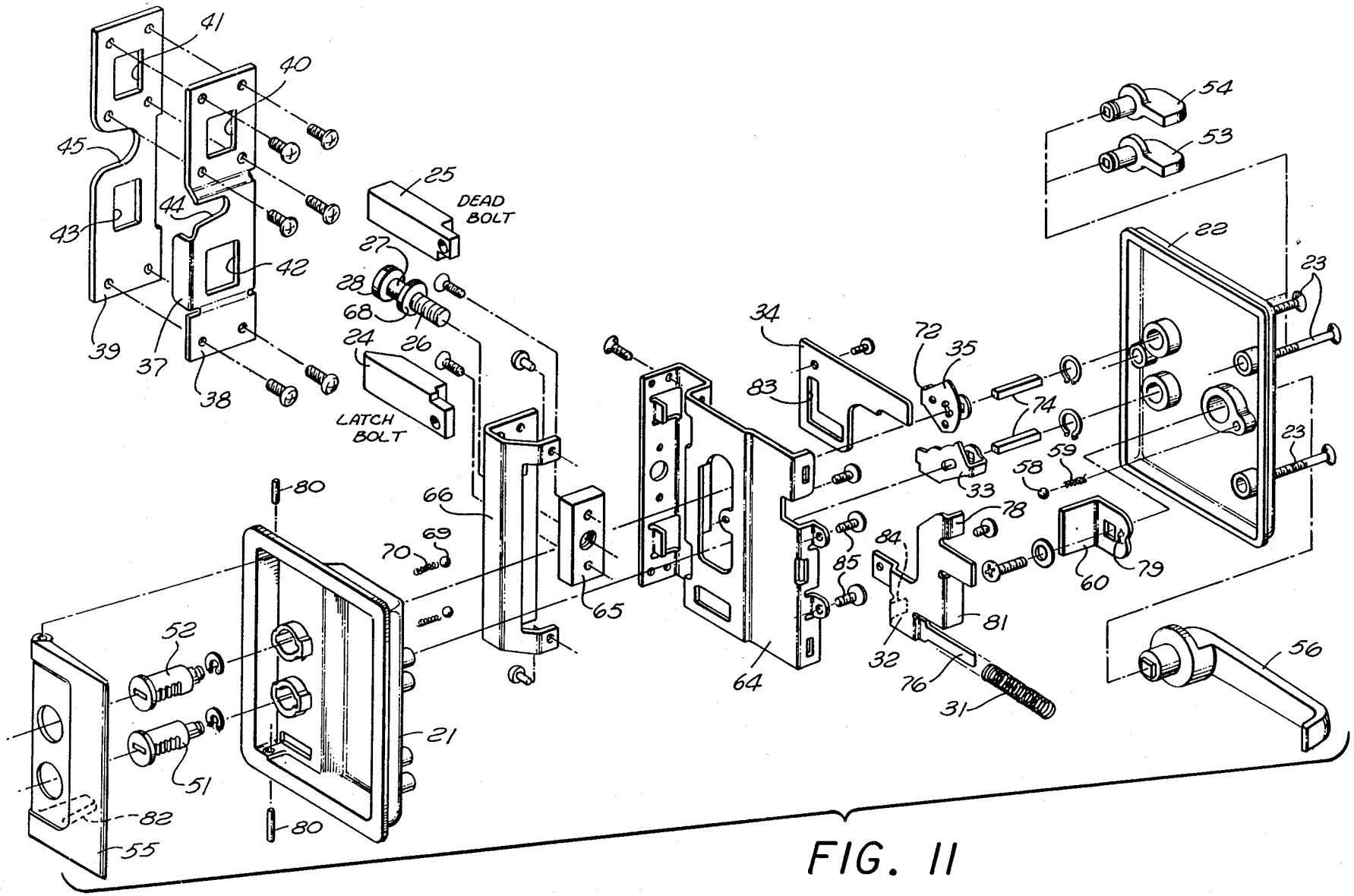
FIG. 11 is an exploded view of the latch of FIG. 2.

The opening 42 for the latch bolt 24 in the inner strike 38 is positioned to receive the latch bolt slightly prior to the door being in the fully closed position. This is known as the precatch position and offers a margin of safety by holding the door latched in the event it is not completely closed, or it becomes unlatched from the fully closed position. The portion of the inner strike 38 with the latch bolt opening 42 preferably is made out of the plane of the remainder of the strike, as seen in FIG. 2, spacing the opening 42 from the opening 43 in the outer strike 39.

An angled surface on the back of the outboard end of the latch bolt 24 creates a ramp effect which causes the bolt to longitudinally travel inboard when it makes contact with the curved outer surface of the flange 37 on the inner strike 38 as the door is closed.

The spring loaded cam plate 32 is attached to the inboard end of the latch bolt and causes the bolt to longitudinally travel in an outboard direction from the housing when it comes in line with the precatch opening 42 in the inner strike 38.

As the door is closed further the latch bolt comes in line with and extends into the opening 43 in the outer strike 39. This is known as the final catch position.

In this door position the dead bolt 25 is in line with openings 40, 41 in both the inner and outer strikes and can be extended into these openings to the locked position by operating the dead bolt locking handle 54 inside the vehicle or the dead bolt key lock 52 from the outside.

The center bolt 26 has a cylindrical shape, with the flange 28 at one end and a threaded portion at the other end for attachment to the latch in a location between the dead bolt and the latch bolt. A back plate 64 is positioned in the housing between the outer and inner covers. The center bolt may be attached directly to the back plate or to a backup block 65 which in turn is attached to the back plate. A front plate 66 may be attached to the back plate 64 when additional strength is desired.

When the latch is installed in the door, the center bolt protrudes through a clearance hole in the edge of the door and bridges the gap between the door and frame. An open sided slot 44 in the inner strike 38 is positioned to accept the neck portion 27 of the center bolt when the door is closed. The flange 28 on the center bolt being outboard of the inner strike and having a larger diameter than the width of the slot 44 prevents the separation of the latch from the keeper when a longitudinal load is applied between the door and the door frame. This construction prevents the door from becoming unlatched due to the latch bolt and dead bolt being separated from the keeper.

The need for this feature comes into play when the vehicle is in an accident or simply when doors and frame structures come under greater loads than they were designed for.

The outer strike 39 has a similar open ended slot 45 that is slightly larger than the outside diameter of the center bolt flange 28. This is done to create a clearance to the center bolt flange so it can be kept short and the overall package compact, but if more strength is needed to resist higher longitudinal loads, both slots could be the same size and the center bolt neck could be long enough to accommodate the thickness of both strikes. Such a design would increase the holding power of the center bolt to the strength of both strikes instead of just one.

The entrance to the slots in both strikes is wider than the slot itself, and is angled into the slot to provide ramps to guide the center bolt into the slot. The ramps act as a guide for vertical alignment between the door and the frame.

The center bolt is threaded into the back plate 64 and bottoms out against a shoulder 68 located on the center bolt shank near the end of the thread. Tightening the center bolt against the shoulder 68 holds it in place and prevents it from becoming loose.

If adjustment to the length of the center bolt is necessary due to an application having a wider or narrower gap between the door edge and door frame, spacers could be added beneath the shoulder 68 or the shoulder could be adjustable by making it separate from the center bolt, in the form of a threaded ring or lock nut. The position of such a ring on the thread would determine the extended length of the center bolt.

As is the case with the latch bolt, a sliding cam plate 34 is attached to the inboard end of the dead bolt 25. Both the dead bolt locking handle 54 and the dead bolt key lock 52 are mechanically attached to the cam 35 that pushes against the dead bolt cam plate 34 to move the dead bolt into the locked or unlocked position when the lock handle or key lock is rotated in the appropriate direction.

When the dead bolt is in either the locked or unlocked position a spring loaded ball 69 located in a blind hole in the housing outer cover is in line with a small hole or detent in the dead bolt cam 35. The spring 70 forces the ball partially into the hole, which holds the cam in that position until the force of the spring holding the ball in the hole is overcome by turning the dead bolt key lock or locking handle. The size of the hole in the cam, relative to the size of the ball determines how far the ball will enter the hole and how strong the detent will be. The larger the hole, the further the ball will enter it and the higher the holding power of the detent will be.

When the dead bolt is in the locked position a perpendicular leg 72 that connects the two parallel legs of the "U" shaped cam 35 is in a position against the edge of a slot 83 in the cam plate as to prevent movement of the dead bolt into the unlocked position without physically rotating the key lock or locking handle. This positive lock prevents the dead bolt from being pried open from outside the vehicle.

The lock mechanism for the latch bolt works in the same way, except the mechanism rotates the latch bolt stop 33 instead of a cam. The stop 33 rotates to an over center, detented position in the path of the latch bolt travel, preventing latch bolt movement and making the latch inoperative. When the lock mechanism is rotated in the opposite direction, the latch bolt stop 33 moves to a detented position out of the way of the latch bolt travel and the latch can be operated.

In both the dead bolt lock mechanism and the latch bolt lock mechanism, the attachment between the key lock cylinder and the cam or stop has sufficient rotary clearance or play to allow the cam or stop to be rotated between the locked and unlocked positions via the inside locking handles without turning the key lock cylinders.

This function is desirable because when the key is removed from the lock cylinder, spring loaded wafers in the lock cylinder extend radially outward into an axial groove in the cylinder lock bore in the outside housing. This prevents rotational movement of the lock cylinder. A second axial groove 180 degrees away from the first groove is in the bore because as the key is being inserted or removed, the wafers ride against the contour of the key which causes them to travel back and forth and alternately extend from both sides of the lock cylinder.

When the key is inserted all the way into the lock cylinder the wafers are completely retracted and rotational movement is not limited, so the lock cylinder can be rotated until the play between the lock cylinder and cam/stop is overcome and it moves the cam/stop into the locked or unlocked (detented) position. The ball detent arrangement holds the cam/stop in this position while the key lock cylinder is rotated back to the original position where the wafers line up with the grooves and the key can be removed.

The inside locking handles 54, 53 are connected to their related cam/stop 35/33 with a rod 74 having a square cross section. One end of this rod is inserted into a square hole in the inboard end of the cylindrical shaft portion of the locking handle. The other end is inserted in a square hole in one leg of the cam/stop.

Both the dead bolt cam and the latch bolt stop are made from thin pieces bent or formed into a "U" shape. One leg of the "U" has the appropriate hole for attachment to the lock cylinder while the opposite leg has the square hole for connection to the rod. Both holes are located on the same centerline, which becomes the pivot point for the cam/stop when it is rotated. Being rigidly connected to the cam/stop via the rod, the locking handles follow the rotary movement of the cam/-stop, and act as pointers to indicate whether the latch bolt and dead bolt are locked or unlocked. The length of the rods can vary, relative to the thickness of the door being used.

When the latch is installed in the door the rods become captured between the lock cylinders and the bottom of the square holes in the locking handles. The rod length is sized to prevent it from sliding far enough in an axial direction to become disconnected from the locking handle or the cam/stop. The locking handles are held into the housing inner cover by snap rings. The lock cylinders are held into the housing outer cover with "E" rings. These methods of attachment are only two of numerous methods that could be used and work equally as well.

The back plate 64 has multiple bends and cutouts and is attached to the inboard side of the housing outer cover. The back plate has rectangular openings that support and guide the linear travel of the latch bolt and the dead bolt and their respective cam plates.

A compression spring 31 positioned on a tang 76 on the latch bolt cam plate 32 pushes against the flat surface of a tab or flange 78 on the backplate 64 to hold the latch bolt in the extended position, until the spring force is overcome when the door is closed or one of the handles is operated to open the door.

Attached to the inboard end of the shaft portion of the inside handle 56 is one leg of the "L" shaped cam 60, while the other leg extends inboard adjacent to lips or flanges 78, 81 on the latch bolt cam plate 32. When the inside handle 56 is rotated in either direction the cam 60 pushes against the lip 78 or 81 and moves the cam plate 32 and latch bolt 24 in a linear direction against the pressure of the spring 31. When the handle is released the force of the spring returns the cam plate and latch bolt to the extended or locked position.

A recess or detent 79 is formed on the cam leg that attaches to the handle, and is positioned over a blind hole in the housing inner cover, which contains the spring 59 and ball 58. This detent arrangement holds the cam and inside handle in a neutral position and prevents handle rattle when it is not in use.

The outside handle 55 is attached to the housing outer cover with vertical hinge pins 80 located near the edge of the handle closest to the free edge of the door. The handle pivots on the hinge pins when operated. A tang 82 extending from the inboard surface of the handle protrudes through an opening in the outer cover and into the area where the latch bolt cam plate 32 is located. A tab 84 (FIG. 5) formed on the latch bolt cam plate 32 is in contact with the end portion of the tang 82 and the force of the cam plate spring 31 pushing the cam plate against the tang holds the handle in a position flush with the outboard surface of the housing outer cover.

When the outside handle 55 is operated, it pivots outward on the hinge pins and the tang pushes against the cam plate. As the force of the cam plate spring is overcome, the cam plate and latch bolt move longitudinally in a direction to retract the bolt from the strike and unlatch the door. When the handle is released, the force of the spring returns the cam plate, bolt and handle back to the original position.

The front plate 66 has somewhat of a "U" cross section and is attached to the back plate 64. The front plate has holes and cutouts positioned to line up with the mounting holes and cutouts in the back plate. The front plate functions to give additional stiffness and support to the back plate when the latch bolt and center bolt come under heavy loads (as described in Safety Standard No. 206). For some applications the front plate might not be required, or it could be manufactured as an integral part of the back plate or of the housing outer cover.

The back plate along with the attached components is mounted to the inboard side of the housing outer cover and held in place with screws 85 threaded into bosses in the cover.

An opening cut through the door close to the free edge is sized to accept the latch assembly. The inner and outer covers, along with the attached components, are installed into the opening from opposite sides of the door, and held together with the screws 23 inserted through holes in the inner cover and into threaded bosses in the outer cover. Flanges on all four sides of both covers are sized slightly larger than the door opening, thus creating a sandwich affect that holds the latch into the door. In addition to the housing screws, there are mounting holes available on the backplate that can be accessed through holes in the door edge.

I claim:

1. In a door latch, the combination of:

a housing;

a latch bolt slidingly carried in said housing;

a dead bolt slidingly carried in said housing;

first control means for moving said latch blot between a door locked position and a door unlocked position;

second control means for moving said dead bolt between a door locked position and a door unlocked position;

with said latch bolt and said dead bolt positioned parallel to each other and sliding along parallel paths, and with said latch bolt and said dead bolt moveable independently of each other;

a center bolt fixed in said housing and projecting outward between said latch bolt and said dead bolt, said center bolt having a center neck of lesser cross-section and an exposed end flange of greater cross-section; and a strike having spaced openings for receiving said latch bolt and said dead bolt, respectively, and having a slot between said openings for receiving said center bolt neck, with said center bolt flange of greater cross-section than said slot.

2. In a door latch, the combination of:

a housing;

a latch bolt slidingly carried in said housing;

first control means for moving said latch bolt between a door locked position and a door unlocked position;

second control means for moving said dead bolt between a door locked position and a door unlocked position;

with said latch bolt and said dead bolt positioned parallel to each other and sliding along parallel paths;

a strike having spaced openings for receiving said latch bolt and said dead bolt, respectively;

with said strike including inner and outer strike plates each having spaced openings for receiving said latch bolt and said dead bolt, respectively, and with the latch bolt opening of said inner strike plate larger than the latch bolt opening of said outer strike plate such that said latch bolt can slide through said inner strike while not sliding through said outer strike plate when in a prelocked position between said door unlocked position and said door locked position.

3. A door latch as defined in claim 2 including means spacing said inner strike plate from said outer strike plate at said latch bolt openings of said strike plates.

4. A door latch as defined in claim 2 including a center bolt fixed in said housing and projecting outward between said latch bolt and said dead bolt, said center bolt having a center section of lesser cross section area and an end section of greater cross section area, and said inner strike plate having a slot for receiving said center bolt, with said inner strike slot of a size for receiving said center bolt center section while not clearing said center bolt end section.

5. In a door latch the combination of:

housing;

a latch bolt slidingly carried in said housing;

a dead bolt slidingly carried in said housing;

first control means for moving said latch bolt between a door locked position and a door unlocked position;

second control means for moving said dead bolt between a door locked position and a door unlocked position;

with said first control means including spring means for urging said latch bolt to said locked position, and latch cam means for moving said latch bolt towards said unlocked position against for urging of said spring means; and with said second control means including dead bolt cam means for moving said dead bolt between said locked and unlocked positions;

a latch key lock carried in said housing and a latch stop connected to said latch key lock for moving said stop towards an unstopped position; and a separate dead bolt key lock carried in said housing and connected to said dead bolt cam means for moving said dead bolt between said locked and unlocked positions independent of said latch key lock.

6. A door latch as defined in claim 5 including a latch bolt locking handle carried in said housing on a side opposite said latch key lock and connected to said latch stop for moving said stop towards said unstopped position, and a dead bolt locking handle carried in said housing adjacent said latch bolt locking handle and connected to said dead bolt cam means for moving said dead bolt between said locked and unlocked positions.

7. A door latch as defined in claim 6 including an outside handle mounted in said housing adjacent said key locks and engaging said latch cam means for moving said latch bolt towards said unlocked position, and an inside handle mounted in said housing adjacent said locking handles and engaging said latch cam means for moving said latch bolt towards said unlocked position.

8. A door latch as defined in claim 7 with said outside handle overlying said key locks and having opening means therethough providing access to each of said key locks.

9. A door latch as defined in claim 8 including detent means engaging said inside handle for maintaining said inside handle in a centered position when said latch bolt is in said locked position, and with said inside handle rotatable both clockwise and counter clockwise from said centered position to engage said latch cam means for moving said latch bolt towards said unlocked position.

10. In a door latch, the combination of:

a housing;

a latch bolt slidingly carried in said housing;

a dead bolt slidingly carried in said hosing;

first control means for moving said latch bolt between a door locked position and a door unlocked position;

second control means independent of said first control means for moving said dead bolt between a door locked position and a door unlocked position;

with said first control means includes:

a latch cam plate connected to said latch bolt for moving said latch bolt between said locked and unlocked positions;

spring means engaging said latch cam plate and said housing for urging said latch bolt to said locked position; and a latch stop carried in said housing and rotatable between a stopped position engaging said latch bolt for preventing movement of said latch bolt and an unstopped position clearing said latch bolt for permitting movement of said latch bolt.

11. A door latch as defined in claim 10 including a latch key lock and a latch bolt locking handle for rotating said latch stop between said stopped and unstopped positions.

12. A door latch as defined in claim 11 including first and second handles mounted on opposite sides of said housing, with each of said handles including means for engaging said latch cam plate for moving said latch bolt from said locked position to said unlocked position.

13. A door latch as defined in claim 11 wherein said latch stop is a U shaped member with aligned openings in the arms of the U, and said latch key lock and said latch bolt locking handle have aligned shafts, with said latch key lock shaft positioned in one of said latch stop aligned openings and said latch bolt locking handle shaft positioned in the other of said latch stop aligned openings.

14. A door latch as defined in claim 11 wherein said second control means includes:

a dead bolt cam plate connected to said dead bolt for moving said dead bolt between said locked and unlocked positions;

a dead bolt cam carried in said housing in engagement with said dead cam plate and rotating between a first position moving said dead bolt to said locked position and a second position moving said dead bolt to said unlocked positions; and a dead bolt key lock and a dead bolt locking handle for rotating said dead bolt cam between said first and second positions independently of said latch bolt cam.

15. A door latch as defined in claim 14 wherein said dead cam is a U shaped member with aligned openings in the arms of the U, and said dead key lock and said dead bolt locking handle have aligned shafts, with said dead key lock shaft positioned in one of said dead cam aligned openings and said dead bolt locking handle shaft positioned in the other of said dead cam aligned openings.

16. In a door latch, the combination of:

a housing;

a latch bolt slidingly carried in said housing;

a dead bolt slidingly carried in said housing parallel with said latch bolt;

first control means for moving said latch bolt between a door locked position and a door unlocked position;

second control means for moving said dead bolt between a door locked position and a door unlocked position;

a center bolt fixed in said housing and projecting outward between said latch bolt and said dead bolt, said center bolt having a center section of lesser cross section area and an end section of greater cross section area; and a strike having spaced openings for receiving said latch bolt and said dead bolt, respectively, said strike including inner and outer strike plates each having spaced openings for receiving said latch bolt and said dead bolt, respectively, and including means spacing said inner strike plate from said outer strike plate at said latch bolt openings of said strike plates, with said inner strike plate latch bolt opening larger than said outer strike plate latch bolt opening, and with said inner strike plate having a slot for receiving said center bolt, with said inner strike slot of a size for receiving said center bolt center section while not clearing said center bolt end section.

17. In a door latch, the combination of:

a housing;

a latch bolt slidingly carried in said housing;

a dead bolt slidingly carried in said housing;

first control means for moving said latch bolt between a door locked position and a door unlocked position;

second control means for moving said dead bolt between a door locked position and a door unlocked position;

said first control means including spring means for urging said latch bolt to said locked position, and latch cam means for moving said latch bold towards said unlocked position against the urging of said spring means;

said second control means including dead bolt cam means for moving said dead bolt between said locked and unlocked positions;

a latch key lock carried in said housing and a latch stop connected to said latch key lock, and having a stopped position for preventing movement of said latch bolt towards said unlocked position and an unstopped position for allowing movement of said latch bolt to said unlocked position, and a separate dead bolt key lock carried in said housing and connected to said dead bolt cam means for moving said dead bolt between said locked and unlocked positions independent of said latch key lock; and an outside handle mounted in said housing adjacent said key locks and engaging said latch cam means for moving said latch bolt towards said unlocked position, and an inside handle mounted in said housing adjacent said locking handles and engaging said latch cam means for moving said latch bolt towards said unlocked position.

18. In a door latch, the combination of:

a housing;

a latch bolt slidingly carried in said housing;

a dead bolt slidingly carried in said housing;

first control means for moving said latch bolt between a door locked position and a door unlocked position;

second control means for moving said dead bolt between a door locked position and a door unlocked position;

a latch key lock carried in said housing for moving said latch bolt towards said unlocked position, and a dead bolt key lock carried in said housing for moving said dead bolt between said locked and unlocked positions; and an outside handle mounted in said housing adjacent said key locks and engaging said latch cam means for moving said latch bolt towards said unlocked position, and overlying said key locks and having opening means therethrough providing access to each of said key locks.

19. In a door latch, the combination of:

a housing;

a latch bolt slidingly carried in said housing;

a dead bolt slidingly carried in said housing parallel with said latch bolt;

first control means for moving said latch bolt between a door locked position and a door unlocked position;

second control means for moving said dead bolt between a door locked position and a door unlocked position;

a center bolt fixed in said housing and projecting outward between said latch bolt and said dead bolt, said center bolt having a center section of lesser cross section area and an end section of greater cross section area;

a strike having spaced openings for receiving said latch bolt and said dead bolt, respectively, said strike including inner and outer strike plates each having spaced openings for receiving said latch bolt and said dead bolt, respectively, and including means spacing said inner strike plate from said outer strike plate at said latch bolt openings of said strike plates, with said inner strike plate latch bolt opening larger than said outer strike plate latch bolt opening, and with said inner strike plate having a slot for receiving said center bolt, with said inner strike slot of a size for receiving said center bolt center section while not clearing said center bolt end section;

said first control means including a latch cam plate connected to said latch bolt for moving said latch bolt between said locked and unlocked positions, spring means engaging said latch cam plate and said housing for urging said latch bolt to said locked position, and a latch stop carried in said housing and rotatable between a stopped position engaging said latch bolt for preventing movement of said latch bolt and an unstopped position clearing said latch bolt for permitting movement of said latch bolt;

said second control means including a dead bolt cam plate connected to said dead bolt for moving said dead bolt between said locked and unlocked position positions, a dead bolt cam carried in said housing in engagement with said dead bolt cam plate and rotating between a first position moving said dead bolt to said locked position and a second position moving said dead bolt to said unlocked position, and a dead bolt key lock and a dead bolt locking handle for rotating said dead bolt cam between said first and second positions;

a latch key lock carried in said housing and a latch stop connected to said latch key lock for moving said stop towards an unstopped position, and a dead bolt key lock carried in said housing and connected to said dead bolt cam plate for moving said dead bolt between said locked and unlocked positions;

a latch bolt locking handle carried in said housing on a side opposite said latch key lock and connected to said latch stop for moving said stop towards said unstopped position, and a dead bolt locking handle carried in said housing adjacent said latch bolt locking handle and connected to said dead bolt cam plate for moving said dead bolt between said locked and unlocked positions;

an outside handle mounted in said housing adjacent said key locks and engaging said latch cam plate for moving said latch bolt towards said unlocked position, and an inside handle mounted in said housing adjacent said locking handles and engaging said latch cam plate for moving said latch bolt towards said unlocked position, with said outside handle overlying said key locks and having opening means therethrough providing access to each of said key locks.

* * * * *